US008270879B2

(12) United States Patent
Numata et al.

(10) Patent No.: US 8,270,879 B2
(45) Date of Patent: Sep. 18, 2012

(54) ELECTROPHOTOGRAPHIC IMAGE FORMING APPARATUS

(75) Inventors: Tetsuya Numata, Suntou-gun (JP); Takahito Ueno, Mishima (JP); Shigeo Miyabe, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 516 days.

(21) Appl. No.: 12/548,012

(22) Filed: Aug. 26, 2009

(65) Prior Publication Data

US 2010/0054805 A1 Mar. 4, 2010

(30) Foreign Application Priority Data

Sep. 1, 2008 (JP) ..... 2008-223143

(51) Int. Cl.
*G03G 15/01* (2006.01)
*G03G 15/08* (2006.01)

(52) U.S. Cl. ..... 399/227; 399/119

(58) Field of Classification Search ..... 399/119, 399/227, 223, 126
See application file for complete search history.

(56) References Cited

U.S. PATENT DOCUMENTS

| | | | | |
|---|---|---|---|---|
| 5,331,373 | A | 7/1994 | Nomura et al. | 355/200 |
| 5,452,056 | A | 9/1995 | Nomura et al. | 355/200 |
| 5,585,889 | A | 12/1996 | Shishido et al. | 355/200 |
| 5,640,650 | A | 6/1997 | Watanabe et al. | 399/117 |
| 5,878,309 | A | 3/1999 | Nomura et al. | 399/111 |
| 5,926,666 | A | 7/1999 | Miura et al. | 399/25 |
| 5,943,529 | A | 8/1999 | Miyabe et al. | 399/111 |
| 5,946,531 | A | 8/1999 | Miura et al. | 399/111 |
| 5,950,047 | A | 9/1999 | Miyabe et al. | 399/111 |
| 5,966,567 | A | 10/1999 | Matsuzaki et al. | 399/111 |
| 6,061,535 | A * | 5/2000 | Yokomori et al. | 399/227 |
| 6,064,843 | A | 5/2000 | Isobe et al. | 399/111 |
| 6,072,968 | A | 6/2000 | Nomura et al. | 399/113 |
| 6,154,623 | A | 11/2000 | Suzuki et al. | 399/111 |
| 6,215,969 | B1 | 4/2001 | Nomura et al. | 399/111 |
| 6,282,390 | B1 | 8/2001 | Miyabe et al. | 399/111 |
| 6,317,572 | B1 | 11/2001 | Miyabe et al. | 399/111 |
| 6,336,017 | B1 | 1/2002 | Miyamoto et al. | 399/116 |
| 6,351,620 | B1 | 2/2002 | Miyabe et al. | 399/111 |
| 6,385,416 | B1 | 5/2002 | Horikawa et al. | 399/111 |
| 6,519,431 | B1 | 2/2003 | Toba et al. | 399/111 |
| 6,542,706 | B2 | 4/2003 | Toba et al. | 399/111 |
| 6,549,736 | B2 | 4/2003 | Miyabe et al. | 399/111 |
| 6,603,939 | B1 | 8/2003 | Toba et al. | 399/103 |

(Continued)

FOREIGN PATENT DOCUMENTS

JP 7-325479 12/1995

(Continued)

*Primary Examiner* — Susan Lee
(74) *Attorney, Agent, or Firm* — Fitzpatrick, Cella, Harper & Scinto

(57) ABSTRACT

An image forming apparatus includes a developing cartridge and rotatable member having a cartridge mounting portion with an engaging portion engageable with a portion of the cartridge. The cartridge includes a developing roller for developing a latent image formed on an image bearing member. The rotatable member is rotatable for moving the mounting portion between a mounting and demounting position for mounting and demounting the cartridge and another position. The engaging portion is movable between a regulating position, in which disengagement of the cartridge from the mounting portion is suppressed, and a permitting position in which the disengagement of the cartridge from the mounting portion is permitted. When the mounting portion is at the another position, the engaging portion is regulated at the regulating position. When the mounting portion is at the mounting and demounting position, the engaging portion is movable from the regulating position to the permitting position.

8 Claims, 15 Drawing Sheets

U.S. PATENT DOCUMENTS

| | | | | |
|---|---|---|---|---|
| 6,608,980 | B2 | 8/2003 | Murayama et al. | 399/111 |
| 6,678,488 | B2 | 1/2004 | Toba et al. | 399/111 |
| 6,714,752 | B2 | 3/2004 | Ueno et al. | 399/117 |
| 6,834,173 | B2 | 12/2004 | Yamaguchi et al. | 399/119 |
| 6,912,365 | B2 | 6/2005 | Ueno et al. | 399/25 |
| 6,934,485 | B2 | 8/2005 | Miyabe et al. | 399/90 |
| 6,954,601 | B2 | 10/2005 | Numagami et al. | 399/90 |
| 6,978,099 | B2 | 12/2005 | Ueno et al. | 399/103 |
| 7,003,247 | B2 | 2/2006 | Koishi et al. | 399/167 |
| 7,062,200 | B2 | 6/2006 | Ueno et al. | 399/111 |
| 7,136,604 | B2 | 11/2006 | Chadani et al. | 399/90 |
| 7,139,502 | B2 | 11/2006 | Koishi et al. | 399/93 |
| 7,149,457 | B2 | 12/2006 | Miyabe et al. | 399/114 |
| 7,155,141 | B2 | 12/2006 | Sato et al. | 399/114 |
| 7,158,736 | B2 | 1/2007 | Sato et al. | 399/111 |
| 7,164,875 | B2 | 1/2007 | Miyabe et al. | 399/111 |
| 7,184,690 | B2 | 2/2007 | Ueno et al. | 399/117 |
| 7,209,682 | B2 | 4/2007 | Numagami et al. | 399/167 |
| 7,212,768 | B2 | 5/2007 | Numagami et al. | 399/111 |
| 7,248,810 | B2 | 7/2007 | Miyabe et al. | 399/90 |
| 7,315,710 | B2 | 1/2008 | Ueno et al. | 399/117 |
| 7,440,715 | B2 | 10/2008 | Numagami et al. | 399/167 |
| 7,450,877 | B2 | 11/2008 | Miyabe et al. | 399/90 |
| 7,457,566 | B2 | 11/2008 | Koishi et al. | 399/167 |
| 7,483,646 | B2 | 1/2009 | Ueno et al. | 399/102 |
| 7,499,663 | B2 | 3/2009 | Sato et al. | 399/106 |
| 7,634,216 | B2 * | 12/2009 | Maeshima et al. | 399/257 |
| 2004/0208673 | A1 * | 10/2004 | Kishigami et al. | 399/227 |
| 2006/0039720 | A1 * | 2/2006 | Miyazawa et al. | 399/227 |
| 2008/0152388 | A1 | 6/2008 | Ueno et al. | 399/167 |
| 2008/0286000 | A1 | 11/2008 | Kimizuka et al. | 399/111 |
| 2008/0286003 | A1 | 11/2008 | Fukuda et al. | 399/119 |
| 2009/0047037 | A1 | 2/2009 | Miyabe et al. | 399/111 |
| 2009/0074454 | A1 | 3/2009 | Sato et al. | 399/113 |
| 2009/0092411 | A1 | 4/2009 | Ueno et al. | 399/105 |

FOREIGN PATENT DOCUMENTS

| | | | |
|---|---|---|---|
| JP | 9-6130 | | 1/1997 |
| JP | 9-146366 | | 6/1997 |
| JP | 2003015382 | A * | 1/2003 |
| JP | 2007-292925 | | 11/2007 |

* cited by examiner (a)

(b)

ELECTROPHOTOGRAPHIC IMAGE FORMING APPARATUS

FIELD OF THE INVENTION AND RELATED ART

The present invention relates to an electrophotographic image forming apparatus including a developing cartridge for developing a latent image formed on an image bearing member and a rotatable member which includes a mounting portion at which the developing cartridge is mounted and demounted.

A cartridge system in which, e.g., a developing member for developing the latent image formed on the image bearing member and a toner accommodating portion for accommodating toner are integrally assembled into a cartridge which is detachably mountable to a main assembly of an electrophotographic image forming apparatus has been conventionally employed.

By this cartridge system, operativity is further improved, so that maintenance of the electrophotographic image forming apparatus can be easily performed by a user himself (herself). The cartridge system has been widely used in the electrophotographic image forming apparatus.

In a color electrophotographic image forming apparatus, a rotatable rotary may be disposed inside an apparatus main assembly. Further, such a constitution that four cartridges containing four developers, respectively, different in color are detachably mountable to the rotary has been known.

The developing cartridge for developing the latent image formed on the image bearing member is detachably mountable to the main assembly of the electrophotographic image forming apparatus.

FIG. 15 is a perspective view for illustrating mounting and demounting of a developing cartridge with respect to a rotary in a conventional image forming apparatus. FIGS. 16(*a*) and 16(*b*) are sectional side elevations for illustrating the mounting and demounting of the developing cartridge with respect to the rotary in the conventional image forming apparatus, wherein FIG. 16(*a*) shows a state in which the developing cartridge is locked in the rotary and FIG. 16(*b*) shows a state in which the lock of the developing cartridge in the rotary is released and the developing cartridge is in a detachably mountable state.

In the conventional image forming apparatus, in order to prevent the developing cartridge from being disengaged from the rotary, the following constitution has been considered (U.S. Pat. No. 6,834,173).

As shown in FIGS. 15, 16(*a*) and 16(*b*), a developing cartridge 70 includes side members 73 and 74 at its both longitudinal end portions and guides 73*a* and 74*a*, provided to the side members 73 and 74, to be guided by guide grooves 81 and 83 provided to a rotary 80. By moving the guides 73*a* and 74*a* along the guide grooves 81 and 83, the developing cartridge 70 is mountable to the rotary 80.

When an image is formed and when the developing cartridge 70 is mounted to the rotary 80, slidable members 75 and 76 are always projected, in arrows P and Q indicated in FIG. 16(*a*), by an urging member 77. For that reason, developing cartridge engaging portions 75*a* and 76*a* provided at end portions of the slidable members 75 and 76 are locked in portions 82 and 84 to be engaged provided to the rotary 80, so that the developing cartridge 70 is in a locked state with respect to the rotary 80. Thus, it is possible to prevent the developing cartridge 70 from being disengaged from the rotary 80 by rotation of the rotary 80.

Further, when a user effects mounting and demounting of the developing cartridge 70, a cover provided to an image forming apparatus main assembly is opened and grip members 78 and 79 connected with the slidable members 75 and 76 are gripped to release an urging force by an urging member 77 (FIG. 16(*b*)). As a result, the slidable members 75 and 76 are retracted in directions of arrows X and Y indicated in FIG. 16(*b*) to release the lock of the developing cartridge engaging portions 75*a* and 76*a* in the portions 82 and 84 to be engaged. Thus, the developing cartridge 70 is demountable from the rotary 80. When the user mounts the developing cartridge 70 to the rotary 80, the above-described operation is performed in reverse order.

However, in recent years, the developing cartridge and the image forming apparatus have been required to be further simplified or downsized.

SUMMARY OF THE INVENTION

A principal object of the present invention is to realize prevention of disengagement of a developing cartridge from a rotatable member and improvement in operativity of a mounting and demounting operation with a simpler constitution.

Another object of the present invention is to realize the prevention of disengagement of the developing cartridge from the rotatable member and the improvement in operativity of the mounting and demounting operation with a further downsized constitution.

According to an aspect of the present invention, there is provided an image forming apparatus comprising:

a developing cartridge including a portion to be engaged and a developing roller for developing a latent image formed on an image bearing member; and a rotatable member which includes a mounting portion for permitting mounting and demounting of the developing cartridge and includes an engaging portion engageable with the portion to be engaged in a state in which the developing cartridge is mounted to the mounting portion, the rotatable member being rotatable for moving the mounting portion between a mounting and demounting position, in which the developing cartridge is mountable and demountable, and another position;

wherein the engaging portion is movable between a regulating position, in which disengagement of the developing cartridge from the mounting portion is suppressed, and a permitting position in which the disengagement of the developing cartridge from the mounting portion is permitted, and wherein in a state in which the mounting portion is located at another position, the engaging portion is regulated at the regulating position and, in a state in which the mounting portion is located at the mounting and demounting position, the engaging portion is movable from the regulating position to the permitting position.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The present invention is particularly effectively applicable to a color electrophotographic image forming apparatus. The electrophotographic image forming apparatus forms an image on a recording material (medium) by using an electrophotographic image forming process. For example, the electrophotographic image forming apparatus may include an electrophotographic copying machine and an electrophotographic printer (an LED printer, a laser beam printer, or the like).

(General Structure of Image Forming Apparatus).

Figure 1:
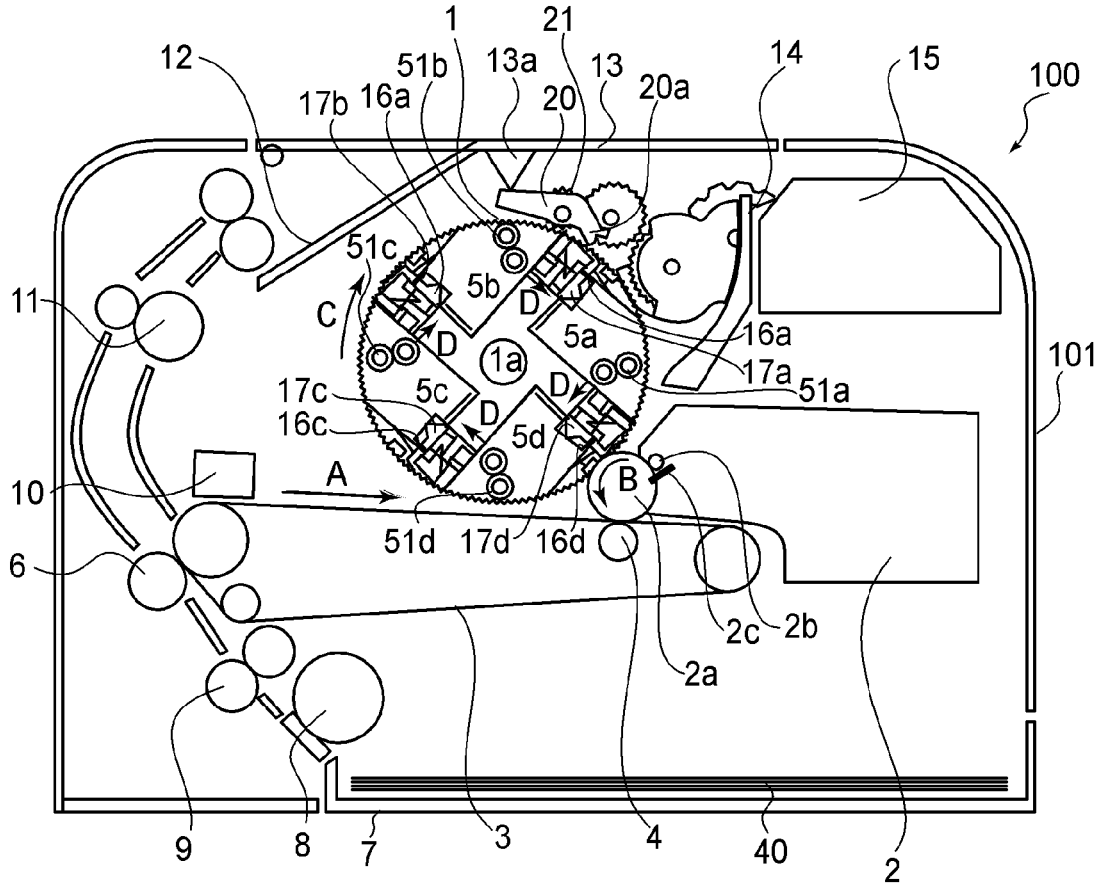
FIGS. 1 to 3 are sectional views each showing a schematic structure of an image forming apparatus in an embodiment of the present invention.
Figure 2:
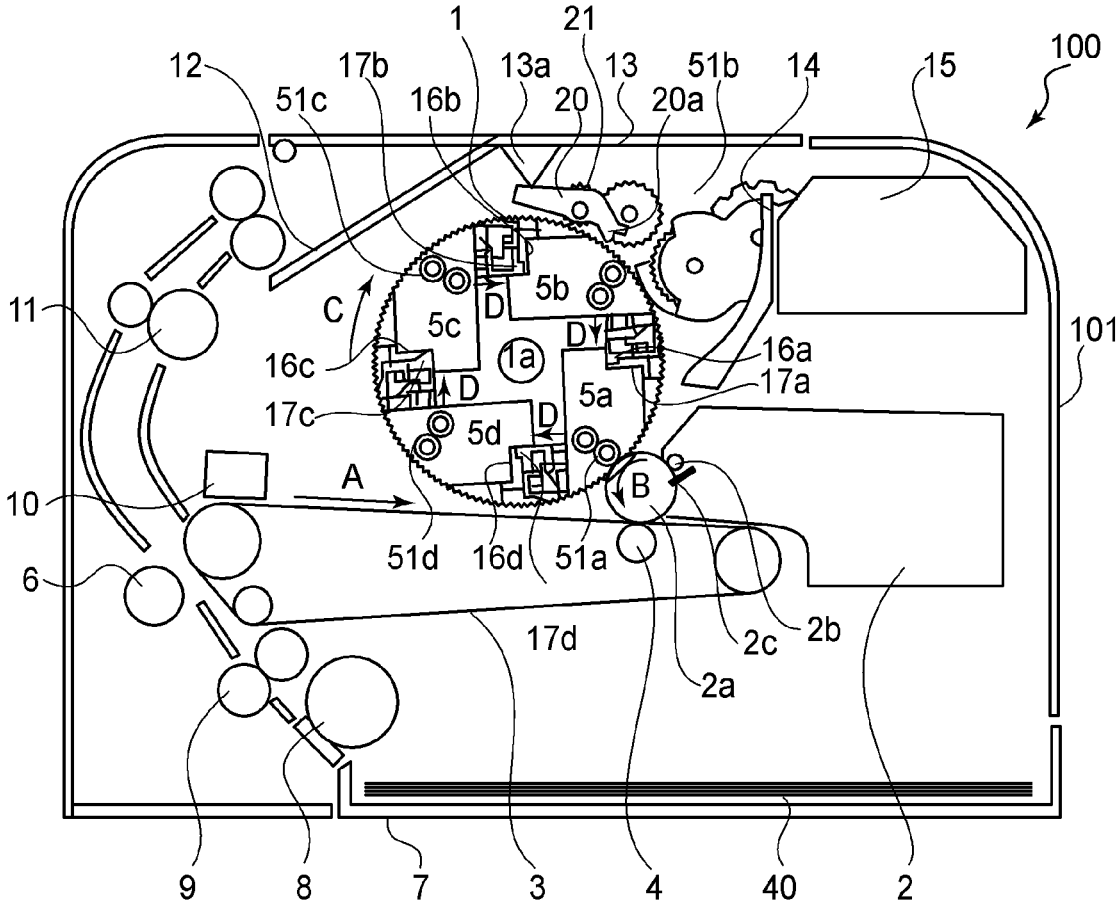
Figure 3:
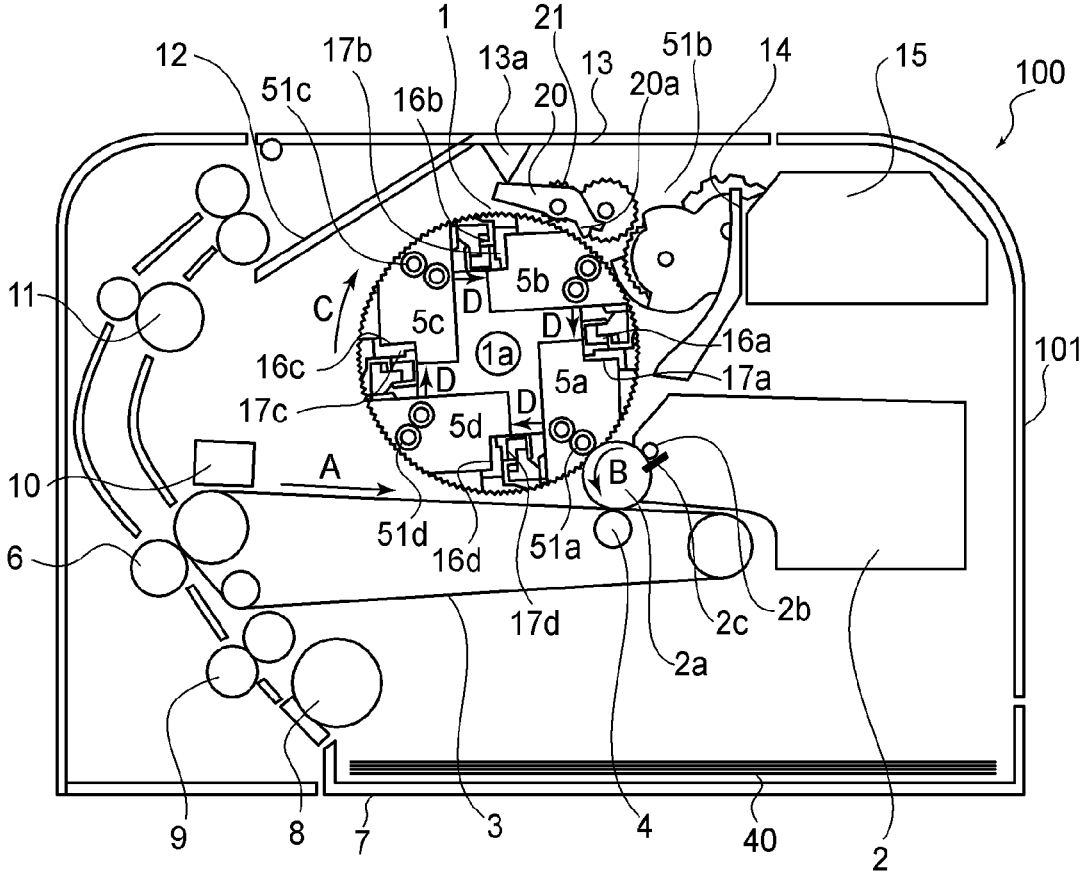

First, an image forming operation of the color image forming apparatus will be described with reference to FIGS. 1 to 3. FIGS. 1 to 3 are sectional views each showing a schematic structure of the image forming apparatus according to an embodiment of the present invention.

The image forming apparatus in this embodiment is a four color-based full-color laser beam printer.

As shown in FIG. 1, an image forming apparatus 100 includes a photosensitive drum 2*a* as an image bearing member. Around the photosensitive drum 2*a*, a charging means 2*b* for electrically charging the photosensitive drum 2*a* uniformly, an exposure means 15 for irradiating the photosensitive drum 2*a* with laser light to form a latent image on the photosensitive drum 2*a*, and a plurality of developing devices each for developing the latent image formed on the photosensitive drum 2*a* with associated toner. The developing devices in this embodiment are a yellow developing cartridge 5*a*, a magenta developing cartridge 5*b*, a cyan developing cartridge 5*c*, and a black developing cartridge 5*d*. Further, a cleaning means 2*c* for removing residual toner remaining on the photosensitive drum 2*a* is also disposed.

In this embodiment, the photosensitive drum 2*a*, the charging means 2*b*, and the cleaning means 2*c* are integrally constituted into a drum cartridge 2 detachably mountable to the main assembly of the image forming apparatus 100. The photosensitive drum 2*a*, the charging means 2*b*, and the cleaning means 2*c* may also be independently constituted.

The yellow developing cartridge 5*a*, the magenta developing cartridge 5*b*, the cyan developing cartridge 5*c*, and the black developing cartridge 5*d* are mounted to a rotary 1 (moving mechanism). The rotary 1 as a rotatable member includes mounting portions to which the respective developing cartridges 5 are mountable and is rotatably held by a main assembly frame.

Each developing cartridge 5 is detachably mountable to an associated mounting portion of the rotary 1 with respect to a radial direction of the rotary 1.

First, the photosensitive drum 2*a* is rotated in a direction of an arrow B indicated in FIG. 1, in synchronism with rotation of an intermediary transfer belt 3 in a direction of an arrow A indicated in FIG. 1. Then, the surface of the photosensitive drum 2*a* is charged uniformly by the charging means 2*b* and at the same time is exposed to light for an yellow image by the exposure means 15, so that an electrostatic latent image for yellow is formed on the photosensitive drum 3*a*.

Simultaneously with the formation of the electrostatic latent image, a gear provided to the rotary 1 receives a driving force from a rotary gear 21 (FIG. 1 and FIG. 7) provided to the image forming apparatus 100, so that the rotary 1 is rotated about a rotary rotational shaft 1*a* in a direction of an arrow C indicated in FIG. 1. As a result, as shown in FIG. 2, the rotary 1 moves the yellow developing cartridge 5*a* (the mounting portion) to a developing position in which the yellow developing cartridge 5*a* opposes the photosensitive drum 2*a*.

A potential difference is provided between the photosensitive drum 2*a* and the developing roller 51*a* (developer carrying member) so that a yellow developer is deposited on the latent image formed on the photosensitive drum 2*a*. As a result, the yellow developer is deposited on the latent image formed on the photosensitive drum 2*a* to develop the latent image. That is, a yellow developer (toner) image is formed on the photosensitive drum 2*a*.

Thereafter, a voltage of an opposite polarity to the charge polarity of the toner is applied to the primary transfer roller 4 disposed inside the intermediary transfer belt 3 to primary-transfer the yellow toner image from the photosensitive drum 2*a* onto the intermediary transfer belt 3.

In the above-described manner, when the primary transfer of the yellow toner image is completed, the rotary 1 is rotationally moved in the direction of the arrow C indicated in FIG. 2 by being supplied with a driving force from the rotary gear 21 of the image forming apparatus 100. Thus, the magenta developing cartridge 5*b*, the cyan developing cartridge 5*c*, and the black developing cartridge 5*d* are successively positioned at the developing position in which an associated developing cartridge opposes the photosensitive drum 2*a*. At the developing position, similarly as in the case of yellow, the electrostatic latent image is formed and developed and an associated toner image is primary-transferred with respect to magenta, cyan and black, so that the resultant four color toner images are superposed on the intermediary transfer belt 3.

During these steps, the secondary transfer roller 6 is in a non-contact state with the intermediary transfer belt 3 as shown in FIGS. 1 and 2. Further, the cleaning unit 10 for the intermediary transfer belt 3 is also in a non-contact state with the intermediary transfer belt 3.

The sheet 40, as a member onto which the toner image is to be transferred, stacked and accommodated in a feeding cassette 7 provided at a lower portion of the image forming apparatus is separated one by one and fed toward a registration roller 9 by a feeding roller 8. The registration roller 9 sends the fed sheet 40 to a position between the intermediary transfer belt 3 and the secondary transfer roller 6. At this position, as shown in FIG. 3, the secondary transfer roller 6 is in a contact state with the intermediary transfer belt 3.

Further, to the secondary transfer roller 6, a voltage of an opposite polarity to the charge polarity of the toner is applied, so that the four color toner images superposed on the intermediary transfer belt 3 as described above are secondary-transferred onto the surface of the conveyed sheet 40.

The sheet 40 on which the toner images are transferred is sent to the fixing device 11. In the fixing device 11, the sheet 40 is heated and pressed, so that the toner images are fixed on the sheet 40. As a result, an image is formed on the sheet 40. Thereafter, the sheet 40 is discharged from the fixing device 11 onto a sheet discharge portion 21 outside the main assembly 11 by the sheet discharging roller 23.

(Developing Cartridge)

The yellow developing cartridge 5*a*, the magenta developing cartridge 5*b*, the cyan developing cartridge 5*c*, and the developing cartridge black developing cartridge 5*d* have the same constitution. Therefore, description of the constitution of the developing cartridges 5*a*, 5*b*, 5*c* and 5*d* will be made by taking the yellow developing cartridge 5*a* as an example. The constitution of the yellow developing cartridge 5*a* will be described with reference to FIGS. 4 and 5.

Figure 5:
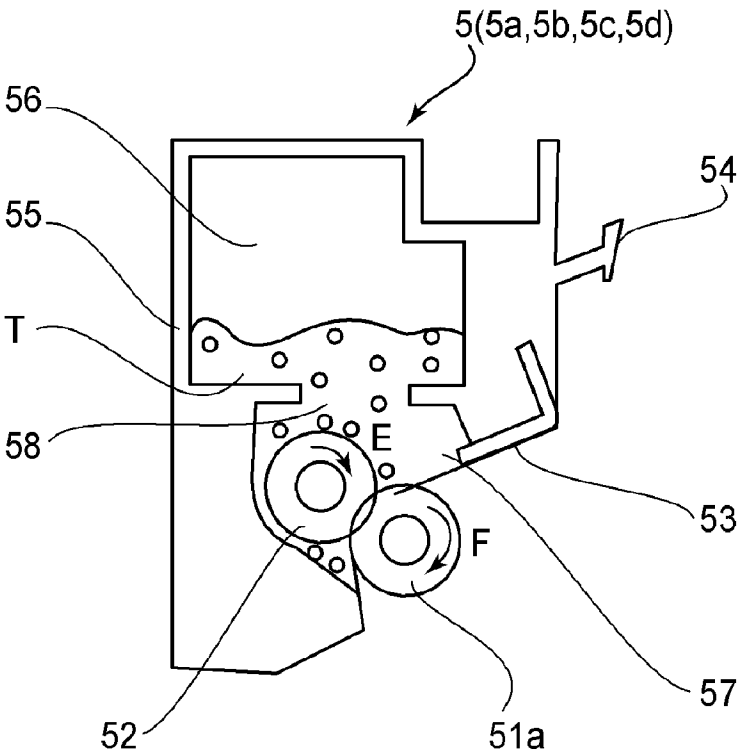
FIGS. 4 and 5 are sectional views each showing a developing cartridge in the embodiment.
Figure 4:
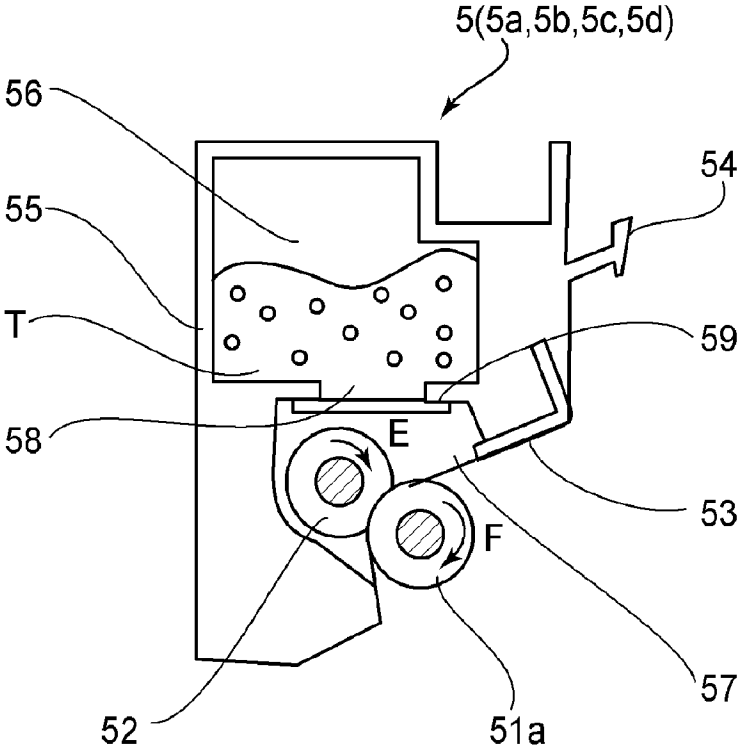

FIGS. 4 and 5 are sectional views showing the developing cartridge 5 (5*a*, 5*b*, 5*c*, 5*d*) in this embodiment.

A developing container 55 of the (yellow developing) cartridge 5*a* is vertically separated into a toner accommodating chamber 56 and a developing chamber 57 which includes the developing roller 51*a* and the toner supplying roller 52 by a toner supply opening 58. In an unused state until the cartridge 5 is delivered to the user, as shown in FIG. 4, at the toner supply opening 58, a film-like toner seal 59 for separating the toner accommodating chamber 56 and the developing chamber 57 from each other is fixed to the developing container 55 by a method such as welding. The toner seal 59 is removed before use.

As shown in FIG. 5, toner T in the toner accommodating chamber 56 falls freely in the developing chamber 57, when the cartridge 5 is located at the developing position in which the cartridge 5 opposes the photosensitive drum 2*a*. The toner T in the developing chamber 57 is supplied to the developing roller 51*a* by the toner supply roller 52. That is, by the rotation of the toner supply roller 52 in a direction of an arrow E indicated in FIG. 5, the toner supply roller 52 supplies the toner to the developing roller 51*a*.

The developing roller 51*a* is constituted by an elastic rubber roller and rotates in a direction of an arrow F indicated in FIGS. 4 and 5. A layer thickness of the toner T on the developing roller 51*a* is regulated by a developing blade 53. Then, the toner T is subjected to development on the photosensitive drum 2*a* at a position in which the developing roller 51*a* opposes the photosensitive drum 2*a*.

The toner T left on the developing roller 51*a* after the development is removed by the toner supply roller 52 and at the same time, the toner in the developing chamber 57 is supplied to the developing roller 51*a* by the toner supply roller 52.

At the developing position, in order to stably bring the developing roller 51*a* into contact with the photosensitive drum 2*a*, the rotary 1 by which the cartridge 5*a* is held is urged toward the photosensitive drum 2*a*. As a result, the developing roller 51*a* of the cartridge 5*a* is placed in a state in which the developing roller 51*a* contacts the photosensitive drum 2*a* at a predetermined urging force.

(Mounting of Developing Cartridge)

Mounting of the developing cartridge will be described with reference to FIGS. 6(*a*) and 6(*b*), which are schematic views for illustrating a sheet of the developing cartridge during mounting.

Figure 6:
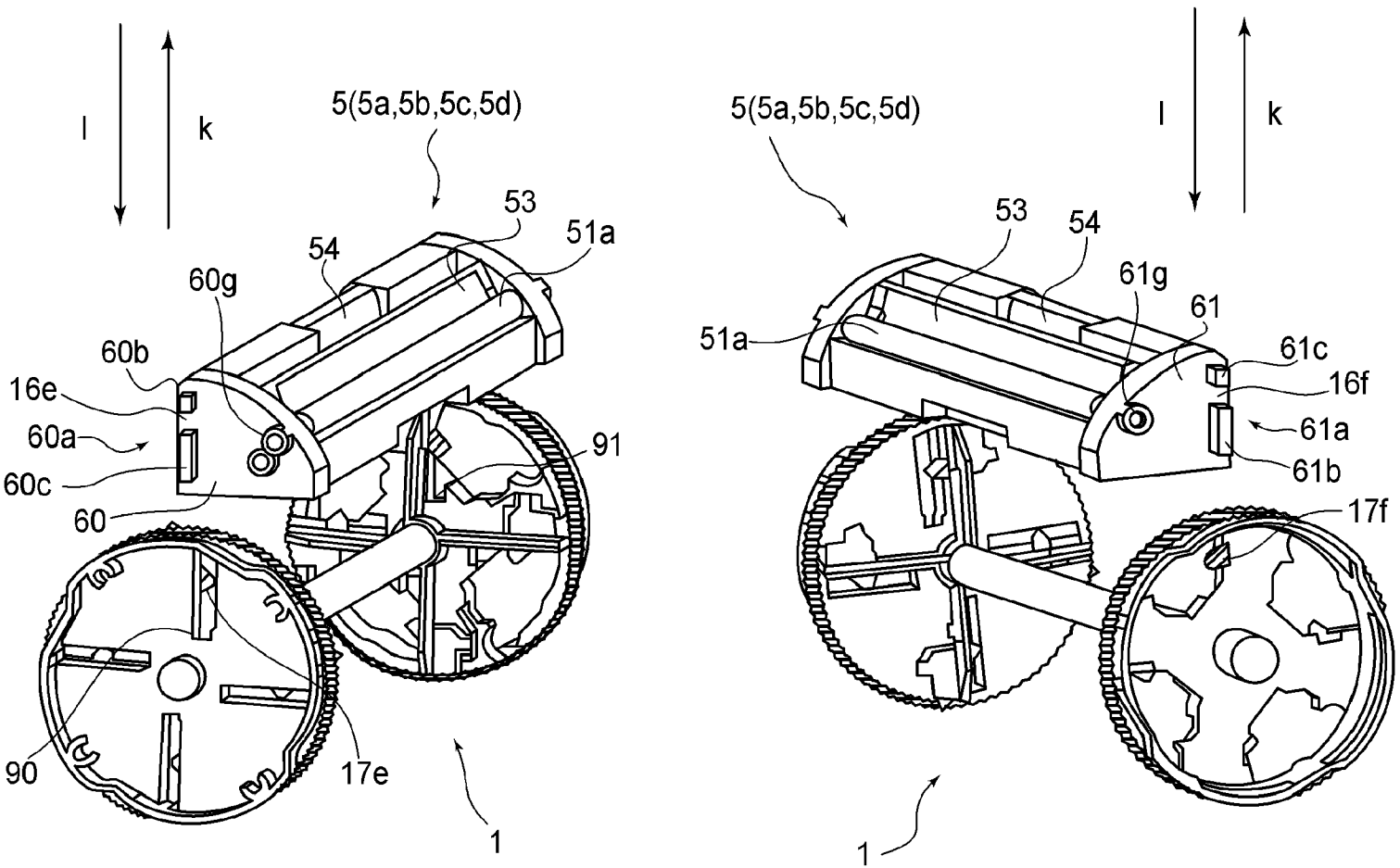
FIGS. 6(*a*) and 6(*b*) are perspective views for illustrating a state at the time of mounting the developing cartridge in the embodiment.

As shown in FIGS. 6(*a*) and 6(*b*), the cartridge 5*a* includes portions to be guided 60*a* and 61*a*, used for mounting and demounting with respect to the rotary 1, provided to side members 60 and 61 which are provided at both end portions of the developing roller with respect to the rotational axis direction of the developing roller (the longitudinal direction of the cartridge 5*a*). The portions to be guided 60*a* and 61*a* are guided by grooves 90 and 91 of the rotary 1, so that the cartridge 5*a* is detachably mountable to the rotary 1. By moving the cartridge 5*a* in a direction of an indicated arrow l, the cartridge 5*a* is mounted to the rotary 1. Further, by moving the cartridge 5*a* mounted to the rotary 1 in a direction of an indicated arrow K, the cartridge 5*a* is demounted from the rotary 1.

The portion to be guided 60*a* is provided at one end of the cartridge 5*a* with respect to the rotational axis direction of the developing roller 51*a*. The portion to be guided 60*a* includes a first portion to be guided 60*b* and a second portion to be guided 60*c*. A cutting portion separating the first portion to be guided 60*b* and the second portion to be guided 60*c* functions as a first portion to be guided 16*e*. On the other hand, a first engaging portion 17*e* engageable with the first portion to be engaged 16*e* is provided to the rotary 1. Similarly, the portion to be guided 61*a* is provided at the other end of the cartridge 5*a* with respect to the rotational axis direction of the developing roller 51*a*. The portion to be guided 61*a* includes a third portion to be guided 61*b* and a fourth portion to be guided 61*c*. A cutting portion separating the third portion to be guided 61*b* and the fourth portion to be guided 61*c* functions as a second portion to be guided 16*f*. On the other hand, a second engaging portion 17*f* engageable with the second portion to be engaged 16*f* is provided to the rotary 1. Therefore, when the cartridge 5*a* is mounted to the rotary 1, the first portion to be engaged 16*e* and the second portion to be engaged 16*f* are engaged with the first engaging portion 17*e* and the second engaging portion 17*f*, respectively. As a result, the cartridge 5*a* is in a locked state with respect to the rotary 1.

In this case, the portion to be guided 60*a* is provided in a longer range with respect to a mounting and demounting direction of the cartridge 5*a* with respect to the image forming apparatus 100. That is, the portion to be guided 60*a* is divided into the first portion to be guided 60*b* and the second portion to be guided 60*c* between which the first portion to be engaged 16*e* is disposed. For that reason, the portion to be guided 60*a* can be kept in a stable attitude with respect to the groove 90 as a guide portion of the rotary 1. The portion to be guided 61*a* is also similarly constituted to be divided into the third portion to be guided 61*b* and the fourth portion to be guided 61*c* between which the second portion to be guided 16*f* is disposed. Further, the groove 91 is also similarly constituted.

In this embodiment, portions to be positioned 60*g* and 61*g* are provided coaxially with the developing roller 51*a* and are configured to be positioned at the rotary 1 (FIGS. 6(*a*) and 6(*b*)).

Further, the second portion to be guided 60*c* and the fourth portion to be guided 61*c* are guided by the grooves 90 and 91 during the mounting and demounting with respect to the rotary 1 but are positioned at the rotary 1 after the mounting.

As described above, the first portion to be engaged 16*e* and the second portion to be engaged 16*f* are provided in the neighborhood of the second portion to be guided 60*c* and the fourth portion to be guided 61*c* which are the portion to be positioned.

In the above-described above, the first engaging portion 17*e* and the second engaging portion 17*f* can be locked in the cartridge 5*a* placed in the stable attitude in the image forming apparatus 100, so that it is possible to enhance positional accuracy.

(Disengagement Preventing Constitution of Developing Cartridge)

Figure 7:
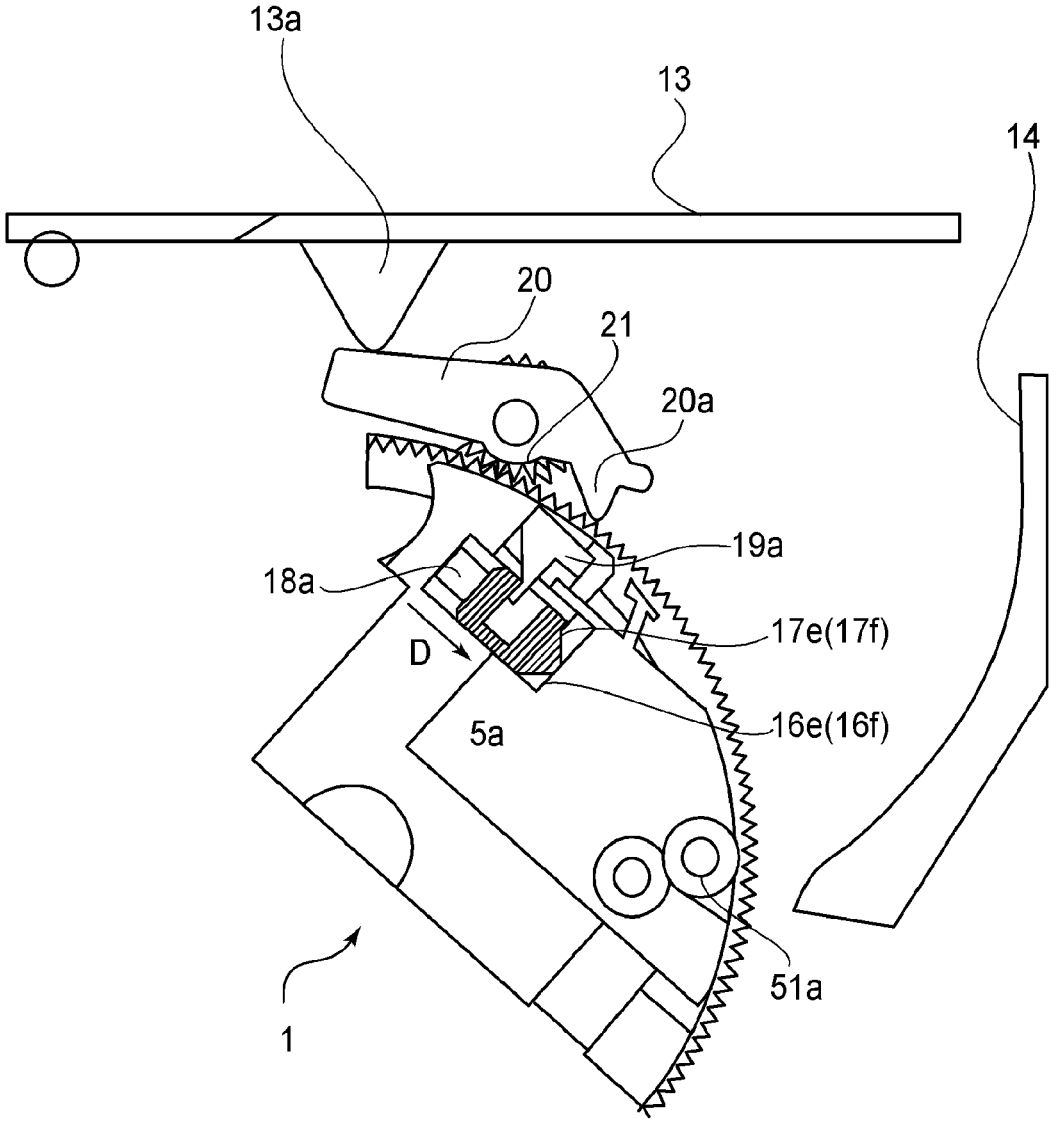
FIG. 7 is en enlarged view of a yellow developing cartridge shown in FIG. 1.
Figure 8:
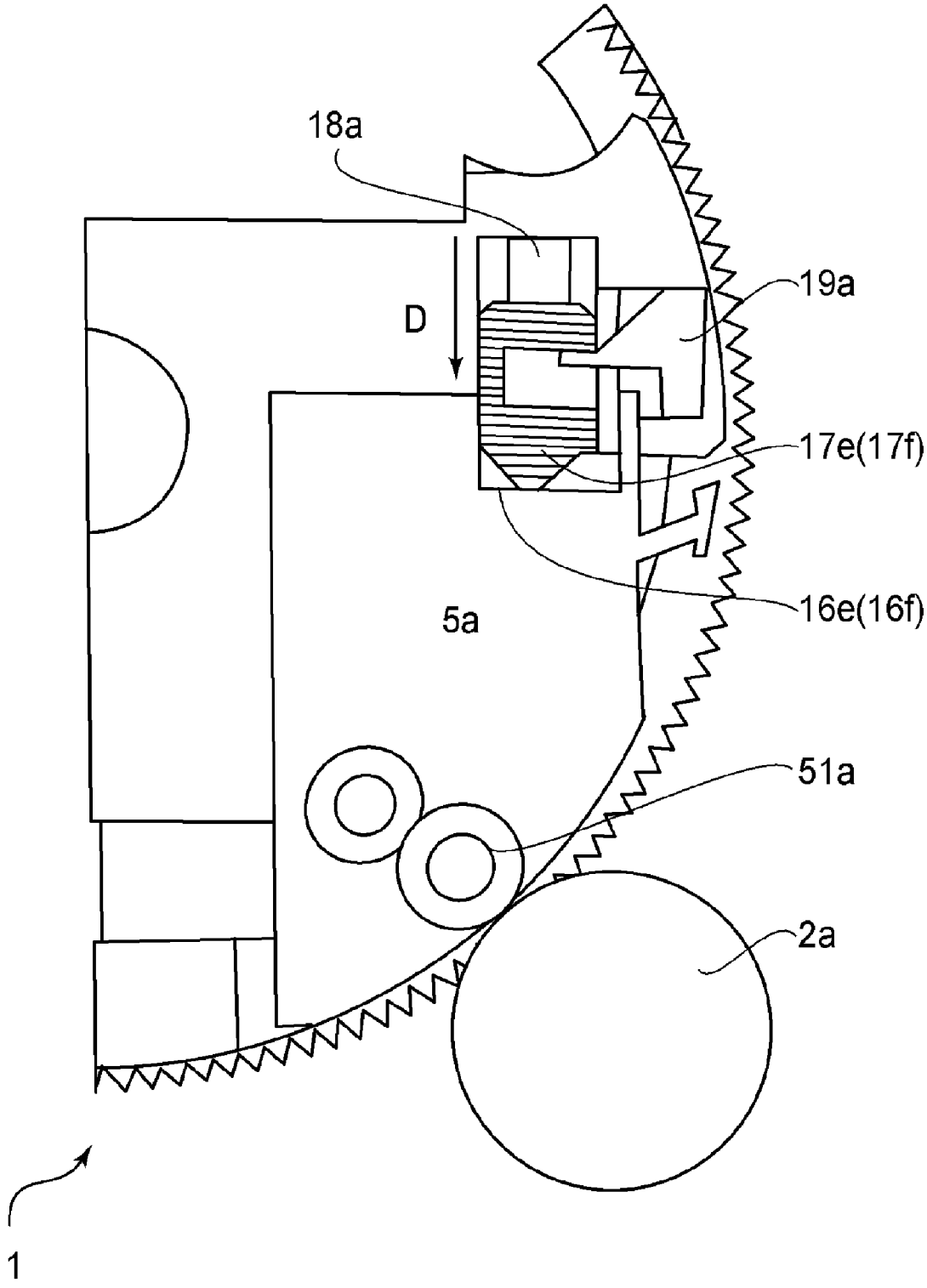
FIG. 8 is an enlarged view of a yellow developing cartridge shown in FIG. 2.

A constitution for holding the cartridge 5*a* by the rotary 1 during the drive of the main assembly of the image forming apparatus 100 will be described in detail with reference to FIGS. 1 and 7 and FIGS. 2 and 8. FIG. 7 is an enlarged view of the cartridge 5*a* shown in FIG. 1 and FIG. 8 is an enlarged view of the cartridge 5*a* shown in FIG. 2.

To the image forming apparatus 100, the mounting and demounting cover 13 (covering member) is provided at an opening of the image forming apparatus 100 in an openable and closable manner. The rotary 1 is provided inside the main assembly from 101. FIGS. 1 and 7 show a state (a closed position state) in which the mounting and demounting cover 13 is closed.

Further, the mounting and demounting cover 13 is interrelated with an interlocking (inter-relating) switch (not shown). For this reason, by closing the mounting and demounting cover 13, the interlocking switch is turned on to drive the image forming apparatus 100 main assembly. Further, by opening the mounting and demounting cover 13 (an open position state), the cartridge 5*a* is in a detachably mountable state with respect to the rotary 1 of the image forming apparatus 100. That is, the cartridge 5*a* passes through the opening of the apparatus main assembly to be detachably mountable to the rotary 1.

In this case, as shown in FIG. 7, the engaging portions 17*e* and 17*f* are urged in the direction of the indicated arrow D by an urging force of an urging member (a coiled spring) 18*a* to be engaged at predetermined positions with the portions to be engaged 16*e* and 16*f* provided to the cartridge 5*a*. The predetermined positions are regulating positions (first position) for the engaging portions 17*e* and 17*f* and at which the cartridge 5*a* is locked in the rotary 1. In this state, portions to be locked 16*eh* and 16*fh* provided to the portions to be engaged 16*e* and 16*f* are regulated by locking portions 17*ek* and 17*fk* provided on a base portion-side of the engaging portions 17*e* and 17*f*. THE locking portions 17*ek* and 17*fk* and the portions to be locked 16*eh* and 15*fh* are parallel surfaces substantially perpendicular to the mounting and demounting D of the cartridge 5*a*.

Figure 10:
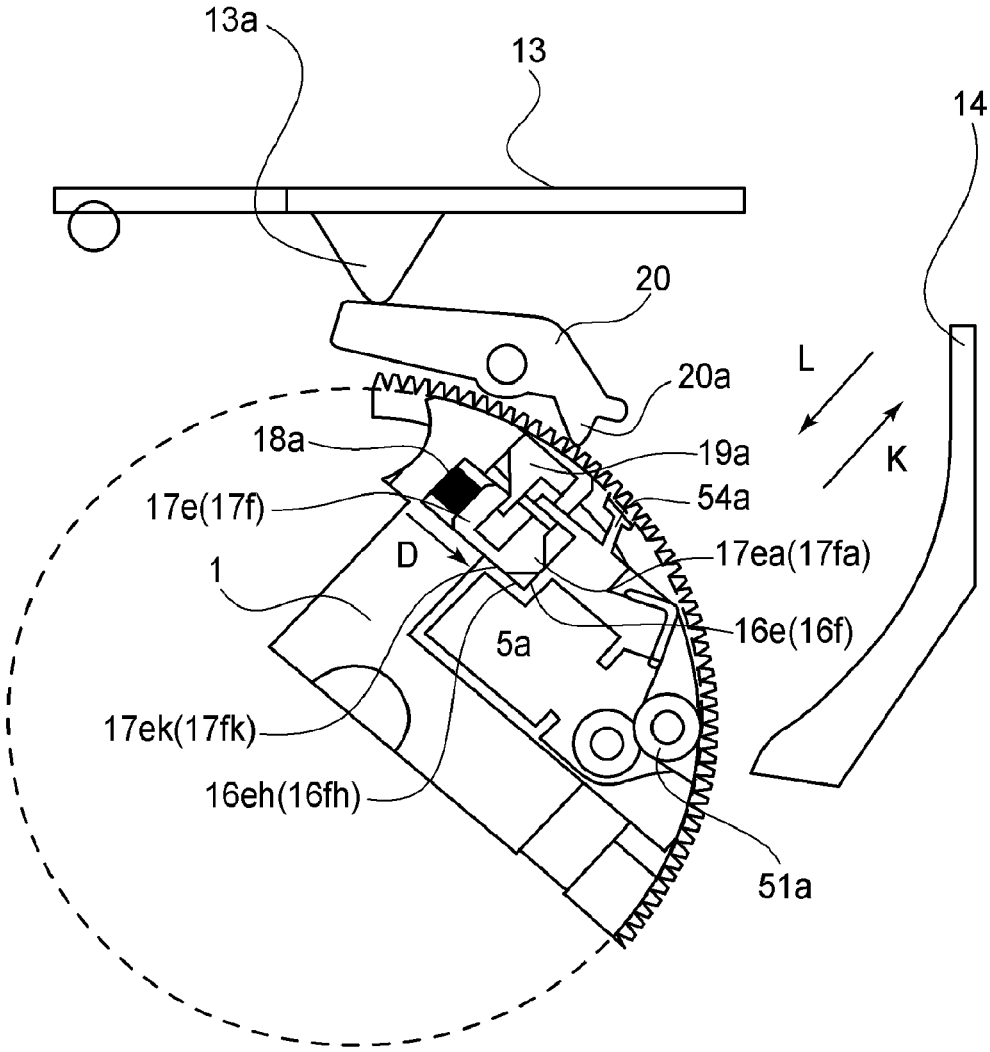
FIGS. 10 to 13 are schematic views for illustrating a mounting and demounting operation of the developing cartridge in the embodiment.
Figure 11:
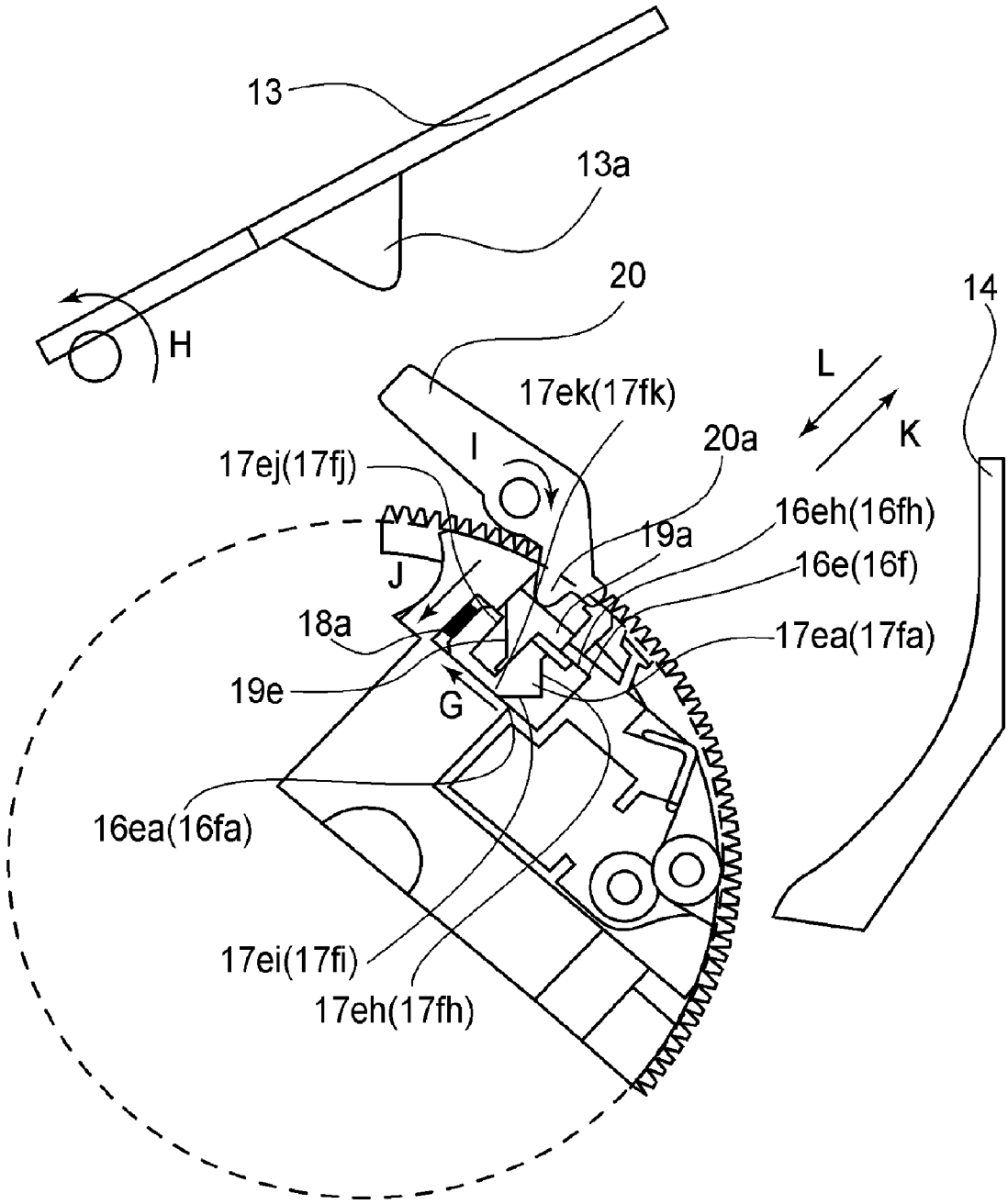
Figure 12:
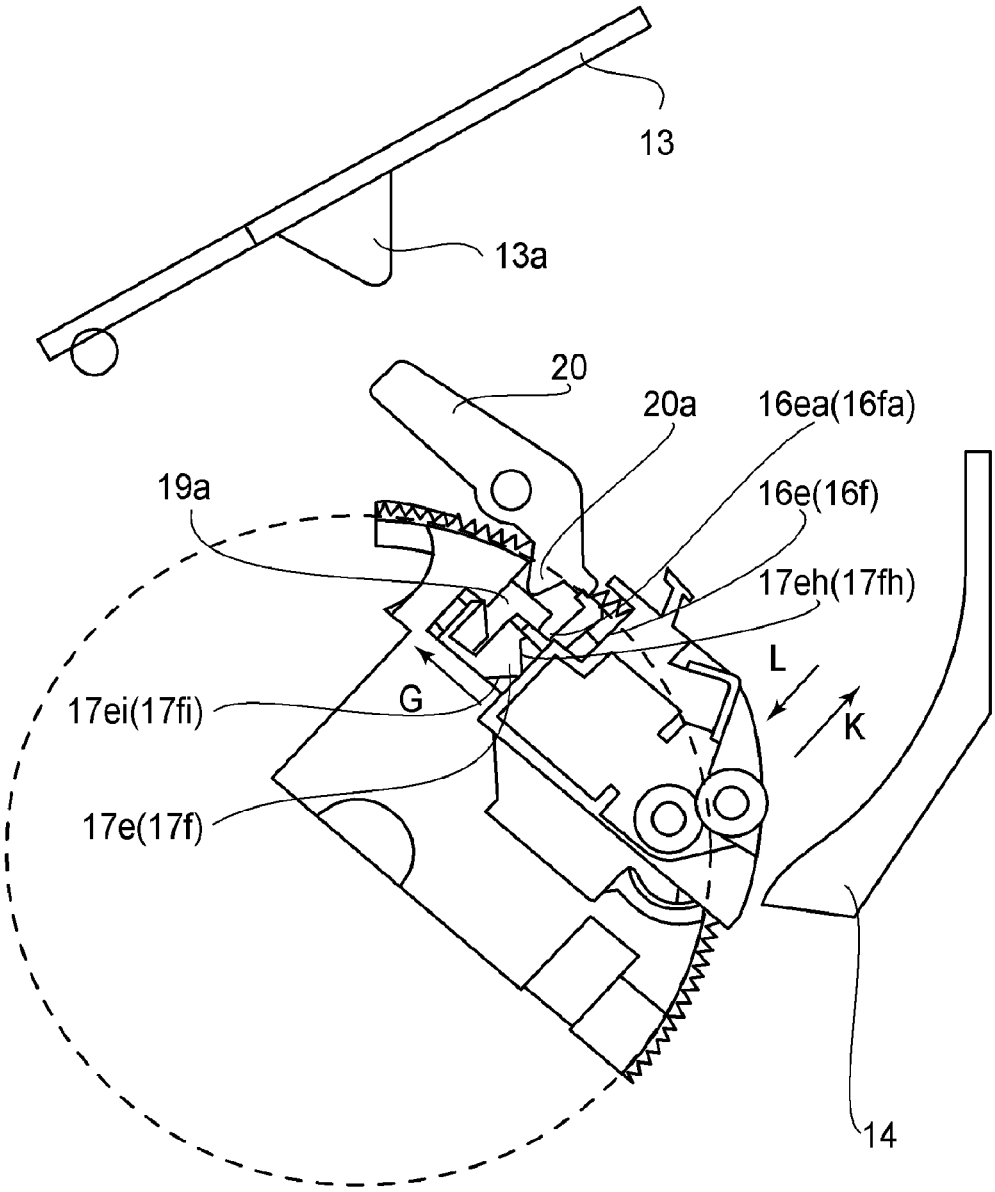

Therefore, even when the rotary 1 is rotated, the cartridge 5*a* is not disengaged from the rotary 1 with respect to a direction of an arrow K (indicated in FIGS. 10 to 12).

During the image formation, the rotary 1 is rotated, so that the cartridge 5*a* is located at the developing position as shown in FIG. 2. Also in this case, as shown in FIG. 8 which is the enlarged view of FIG. 2, the portions to be engaged 16*e* and 16*f* are engaged with the engaging portions 17*e* and 17*f*, so that the cartridge 5*a* is held by (locked in) the rotary 1. Further, by a similar constitution, the magenta developing cartridge 5*b*, the cyan developing cartridge 5*c* and the black developing cartridge 5*d* are also held by the rotary 1.

Therefore, when the interlocking switch is turned on, i.e., during the drive of the image forming apparatus 100 main assembly, all the yellow developing cartridge 5*a*, the magenta developing cartridge 5*b*, the cyan developing cartridge 5*c*, and the black developing cartridge 5*d* are placed in the locked state with respect to the rotary 1. For that reason, it is possible to reliably prevent such a trouble that the image forming apparatus 100 main assembly is caused to be driven while the rotary 1 does not hold the respective developing cartridges 5*a* and 5*d*.

(Mounting and Demounting of Developing Cartridge)

FIG. 1 is a sectional view showing a state in which the yellow developing cartridge 5*a* is located at the developing cartridge mounting and demounting position which is shifted in phase by 45 degrees from the developing position shown in FIG. 2 toward an upstream side with respect to the rotational direction of the rotary 1. The rotary 1 rotates for moving the mounting portion for each cartridge 5 between the mounting and demounting and another position (including the developing position).

The mounting and demounting of the yellow developing cartridge 5*a*, the magenta developing cartridge 5*b*, the cyan developing cartridge 5*c* and the black developing cartridge 5*d* are performed at the above-described mounting and demounting position.

Figure 9:
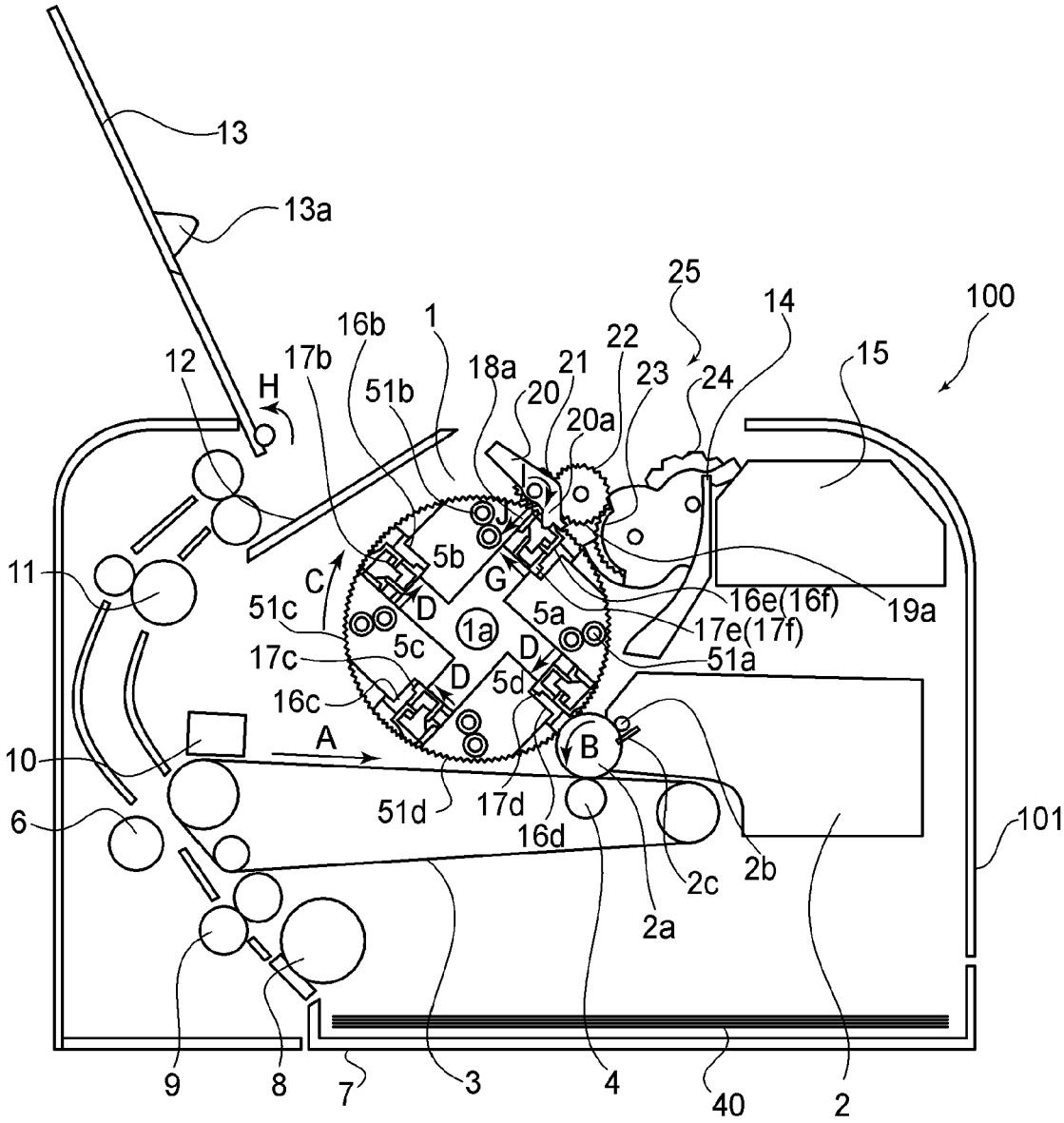
FIG. 9 is a sectional view showing a state in which a mounting and demounting cover in the embodiment is opened.

FIG. 9 is a sectional view showing a state in which the yellow developing cartridge 5*a* of the four developing cartridges is located at the mounting and demounting position and the mounting and demounting cover 13 is opened.

When the yellow developing cartridge 5*a*, the magenta developing cartridge 5*b*, the cyan developing cartridge 5*c* and the black developing cartridge 5*d* are mounted and demounted, the user can access each of the developing cartridges 5 by opening the mounting and demounting cover 13 (the open state).

Figure 13:
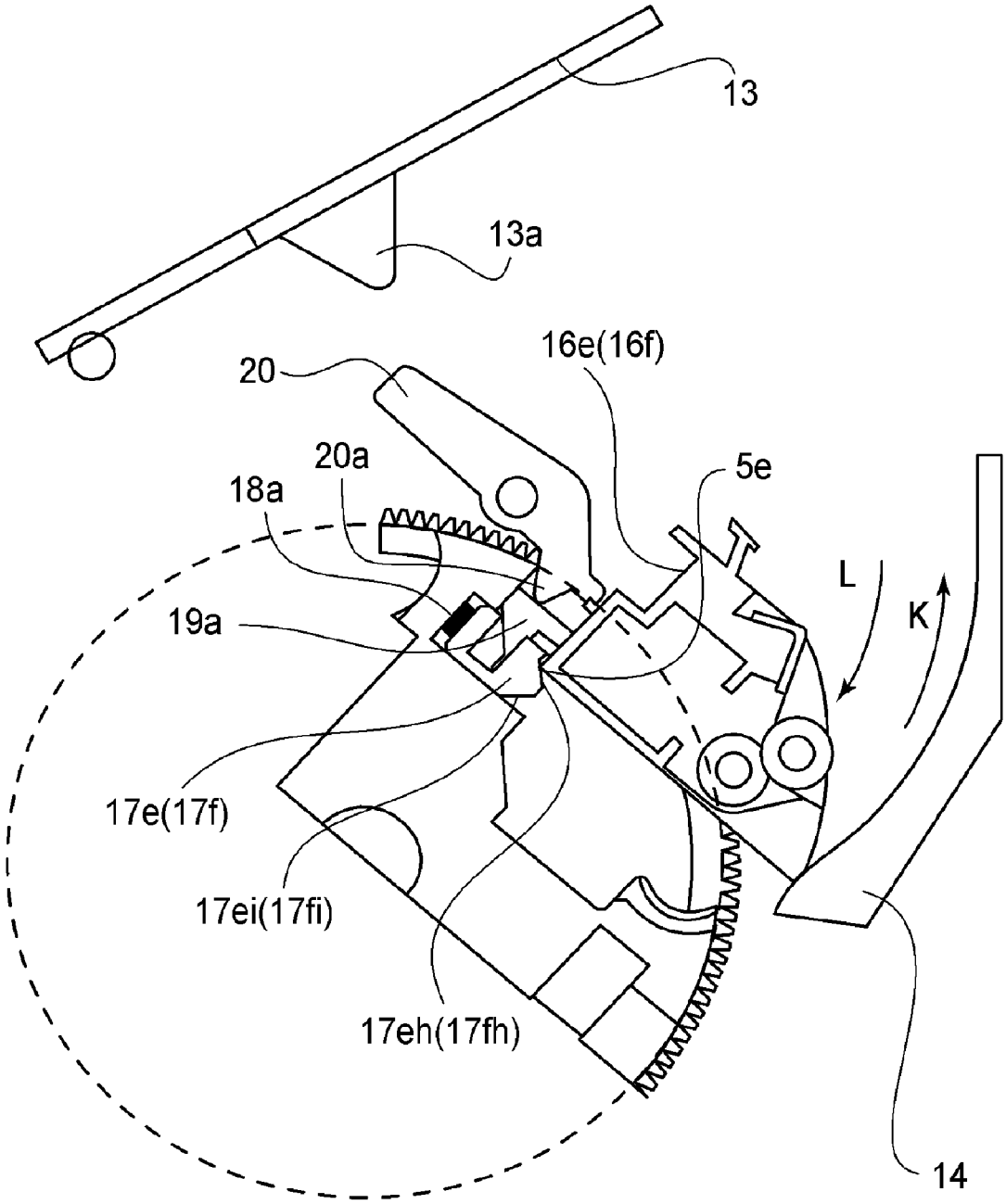

FIGS. 10 to 13 are schematic views for illustrating the mounting and demounting operation of the developing cartridge. All the four developing cartridges are mounted and demounted in the same manner and therefore the mounting and demounting operation of the yellow developing cartridge 5*a* will be described in detail. FIG. 10 is a schematic view showing a state in which the developing cartridge 5*a* is located at the mounting and demounting position in which the developing cartridge 5*a* is mountable in and demountable from the image forming apparatus 100. FIG. 11 is a schematic view showing a state in which the mounting and demounting cover 13 placed in the state of FIG. 10 is opened. FIG. 12 is a schematic view for illustrating a process of demounting the developing cartridge 5*a* placed in the state of FIG. 11. FIG. 13 is a schematic view showing a state in which the developing cartridge 5*a* placed in the state of FIG. 12 is further demounted.

As shown in FIG. 10, when the mounting and demounting cover 13 is closed, a projection 13*a* as an urging portion urges a releasing member 20. A projection 20*a* of the releasing member 20 is in a state in which the projection 20*a* is retracted from a slidable member 19*a* for releasing the lock of the cartridge 5*a*.

When the mounting and demounting cover 13 is opened (with respect to a direction of an arrow H indicated in FIG. 11), the interlocking switch is turned off to release the drive of the image forming apparatus 100 main assembly. At the same time, as shown in FIG. 11, by the opening of the mounting and demounting cover 13, the releasing member 20 urged by a spring (not shown) is rotated in a direction of an indicated arrow I. Then, the projection 20*a* provided to the releasing member 20 presses the slidable member 19*a* for the lock release with respect to a direction of an indicated arrow J. For that reason, an inclined surface 19*e* provided to the slidable member 19*a* presses corner portions 17*ej* and 17*fj* provided to the engaging portions 17*e* and 17*f*. As a result, the engaging portions 17*e* and 17*f* are moved in the direction of the arrow G. That is, the engaging portions 17*e* and 17*f* are moved in a direction in which the engaging portions 17*e* and 17*f* are retracted from the portions to be engaged 16*e* and 16*f*. As a result, only projections 17*ea* and 17*fa* as temporarily locking portions provided on end sides of the engaging portions 17*e* and 17*f* enter the portions to be engaged 16*e* and 16*f*. In other words, with respect to the mounting and demounting direction of the cartridge 5*a*, the projections 17*ea* and 17*fa* and the portions to be locked 16*eh* and 16*fh* overlap with each other but the locking portions 17*ek* and 17*fk* and the portions to be locked 16*eh* and 16*fh* do not overlap with each other. The projections 17*ea* and 17*fa* have inner inclined surfaces 17*ei* and 17*fi* and outer inclined surfaces 17*eh* and 17*fh*. These inclined surfaces 17*ei*, 17*fi*, 17*eh* and 17*fh* are inclined with respect to the positions 17*ek* and 17*fk*.

In this state, the engaging portions 17*e* and 17*f* are located at permitting positions (second position). At this position, the yellow developing cartridge 5*a* is placed in a temporarily locked state with respect to the rotary 1. In this temporarily locked state, the user can mount and demount the yellow developing cartridge 5*a*. Further, in this state, the magenta developing cartridge 5*b*, the cyan developing cartridge 5*c* and the black developing cartridge 5*d* are placed in a locked state with respect to the rotary 1.

When the user moves the temporarily locked yellow developing cartridge 5*a* in a direction of an arrow K indicated in FIG. 11 while gripping a grip 54, the corner portions 16*ea* and 16*fa* as a part of the portions to be engaged 16*e* and 16*f* press the inner inclined surfaces 17*ei* and 17*fi* provided to the engaging portions 17*e* and 17*f*. As a result, the engaging portions 17*e* and 17*f* are further retracted from the portions to be engaged 16*e* and 16*f*. Thus, the lock of the yellow developing cartridge 5*a* in the rotary 1 is completely released, so that the user can demount the yellow developing cartridge 5*a* from the image forming apparatus 100 main assembly.

On the other hand, when the yellow developing cartridge 5*a* is mounted, first, the mounting and demounting cover 13 is opened. As a result, the engaging portions 17*e* and 17*f* are moved from the regulating position to the permitting position. Then, the yellow developing cartridge 5*a* is moved in the direction of the indicated arrow L. At this time, as shown in FIG. 13, a corner portion 5*e* of the yellow developing cartridge 5*a* contacts and presses the outer inclined surfaces 17*eh* and 17*fh* provided to the engaging portions 17*e* and 17*f*. As a results. the engaging portions 17*e* and 17*f* are further moved in the direction of the indicated arrow G, so that the yellow developing cartridge is mounted to the rotary 1. Thus, the portions to be engaged 16*e* and 16*f* and the engaging portions 17 and 17*f* are placed in the temporarily locked state again. In this way, the temporarily locked state is established during the mounting, so that the user can have mounting feeling by the mounting operation.

As described above, a retracting mechanism (the engaging portions 17*e* and 17*f*) retractable with respect to the portions to be engaged 16*e* and 16*f* is provided. As a result, in this embodiment, compared with the case where the retracting mechanism is provided to the cartridge, it is possible to downsize and simplify not only the cartridge but also the image forming apparatus as a whole. Further, in interrelation with the opening and closing of the mounting and demounting cover 13, the yellow developing cartridge 5*a* and the rotary 1 are configured to establish the temporarily locked state in which the yellow developing cartridge 5*a* is detachably mountable to the rotary 1. For this reason, as shown in FIG. 13, the user can perform the mounting and demounting operation only by gripping the grip 54. Further, by demount the developing cartridge 5 along the guiding member 14, the mounting and demounting operation can be further facilitated.

Next, a method in which the user accesses the magenta developing cartridge 5*b*, the cyan developing cartridge 5*c* and the black developing cartridge 5*d* and mounts and demounts the cartridges will be described with reference to FIGS. 14(*a*), 14(*b*) and 14(*c*).

Figure 14:
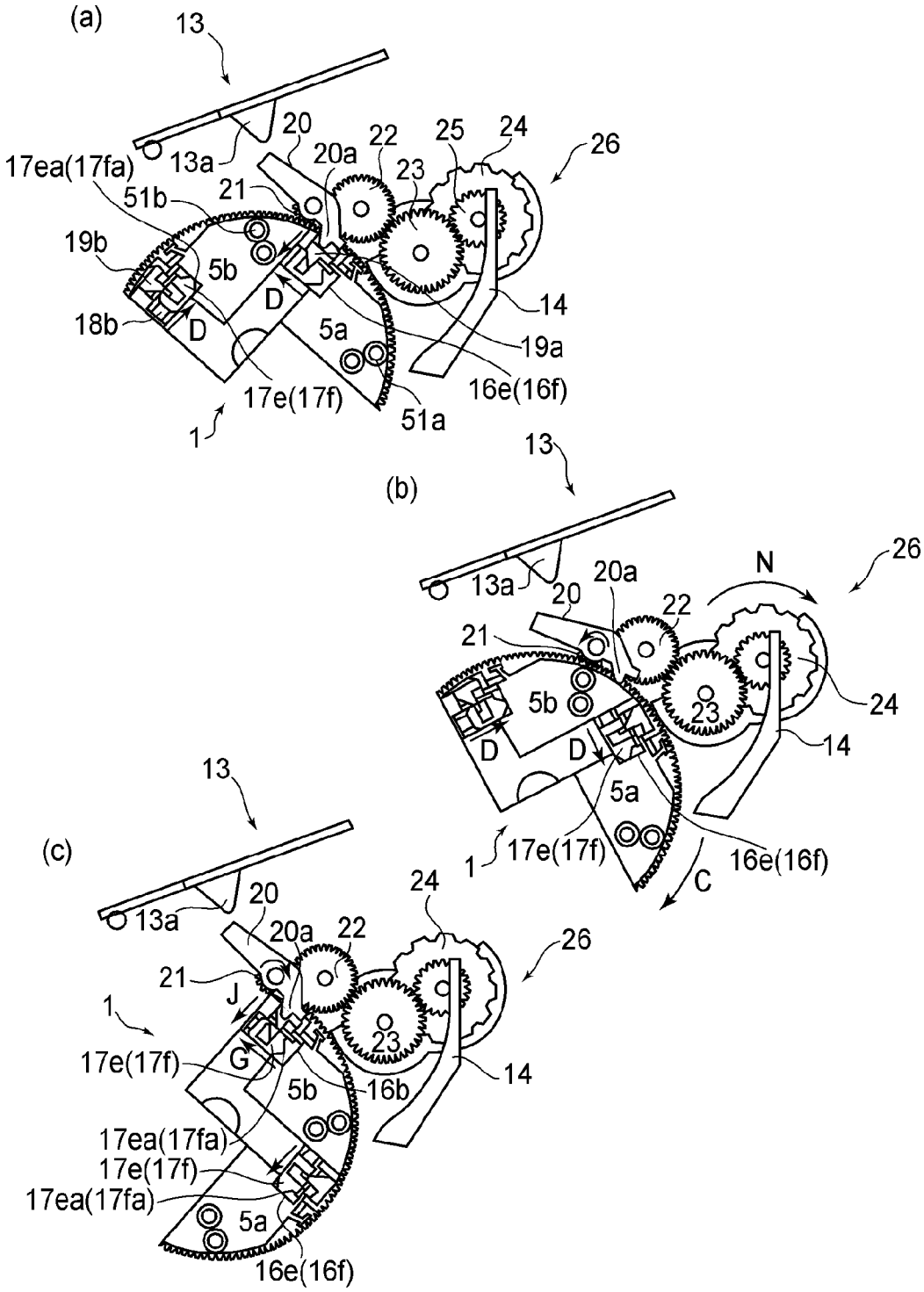
FIGS. 14(*a*), 14(*b*) and 14(*c*) are schematic views for illustrating an operation of a manually driving unit in the embodiment.
Figure 15:
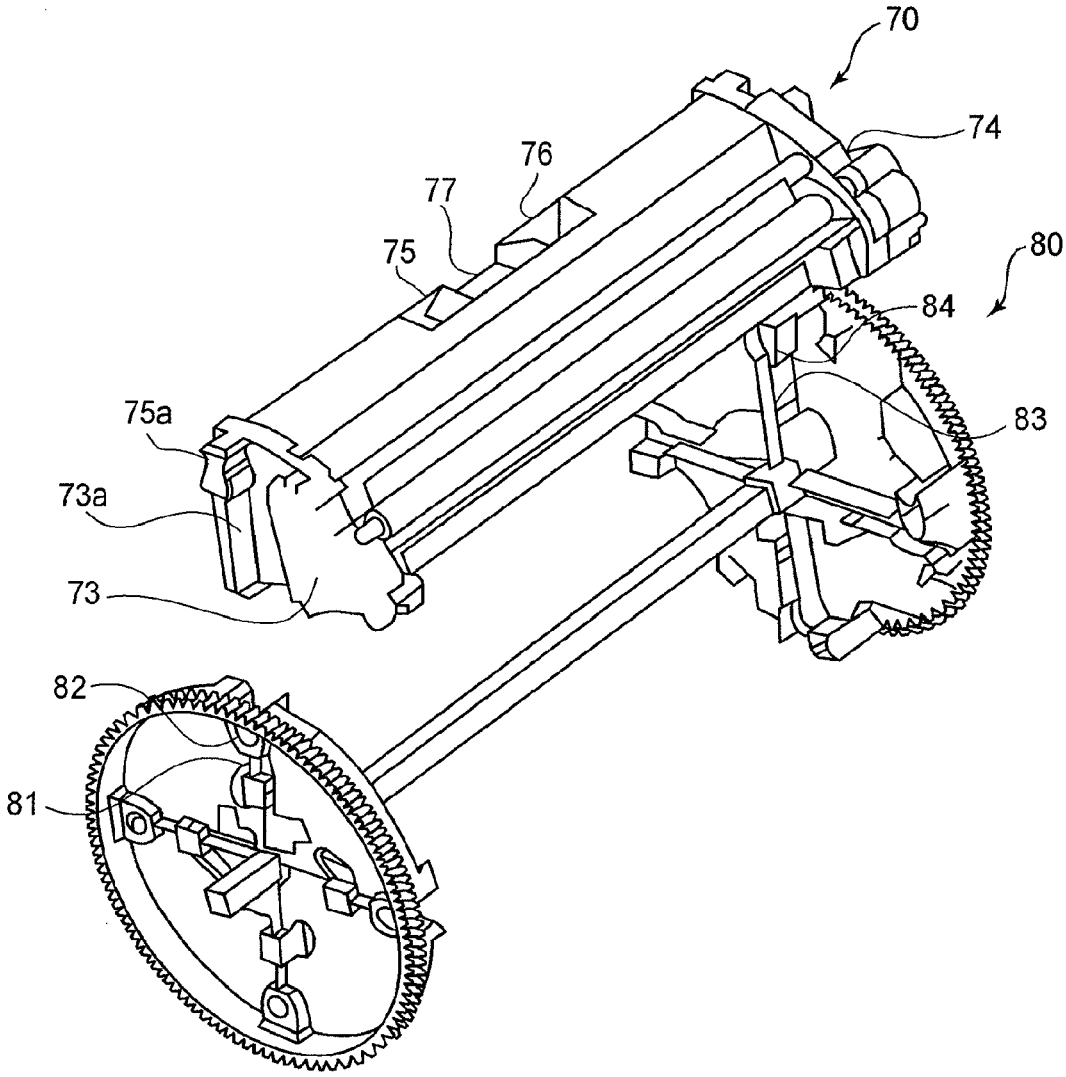
FIG.15 PRIOR ART
FIG. 15 is a perspective view for illustrating mounting and demounting of the developing cartridge with respect to a rotary in a conventional image forming apparatus.
Figure 16:
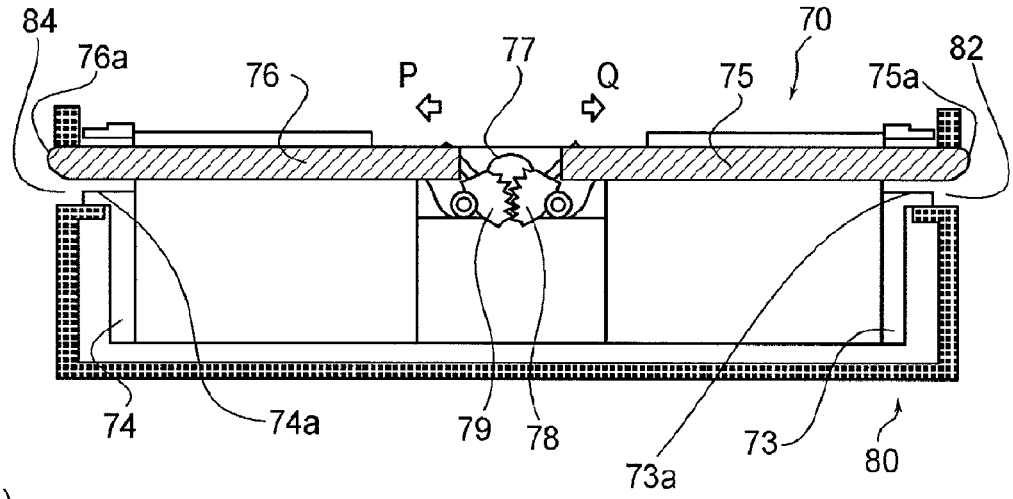
FIG.16 PRIOR ART
FIGS. 16(*a*) and 16(*b*) are sectional side elevations for illustrating the mounting and demounting of the developing cartridge with respect to the rotary in the conventional image forming apparatus.
Figure 16:
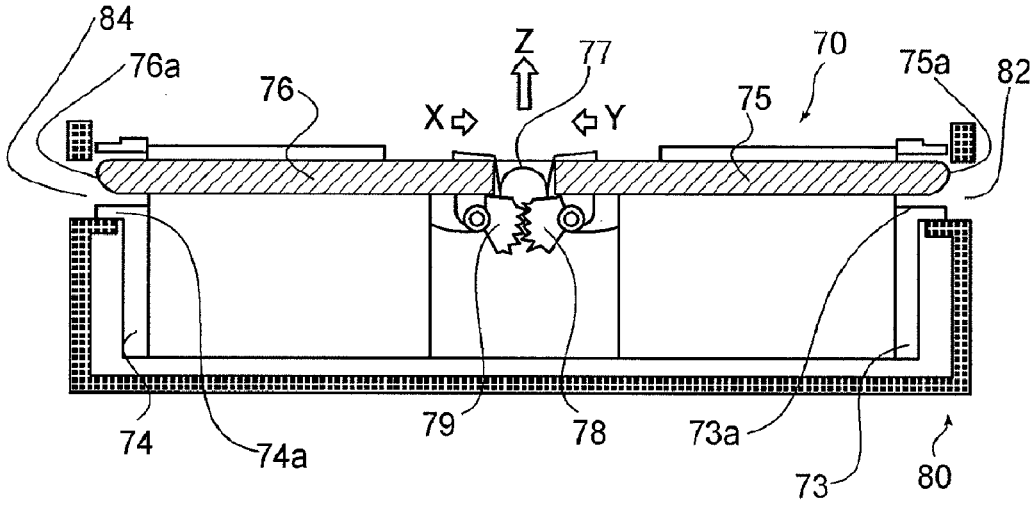
FIG.16 PRIOR ART

FIGS. 14(*a*) to 14(*c*) are schematic views for illustrating an operation of a manually driving unit 26.

As shown in FIG. 14(*a*), the image forming apparatus 100 main assembly is provided with the manually driving unit 26 by which the user can manually rotates the rotary 1. The manually driving unit 26 includes a dial 24 as a manually operating portion to be operated by the user, a dial gear 25 integrally provided to the dial 24, and a swingable gear 23 contacting the dial gear 25. When the mounting and demounting cover 13 is in the closed state, the dial is covered with the mounting and demounting cover 13 and when the mounting and demounting cover 13 is in the open state, the dial 24 is exposed from the main assembly frame 101. As a result, when the mounting and demounting cover 13 is opened, the user can recognize the need of operation of the dial 24.

As shown in FIG. 14(*b*), when the user rotates the dial 24 in a direction of an indicated arrow N, the manually driving unit 26 is swung to a position in which the swingable gear 23 contacts an intermediary drive transmission gear 22.

Here, as described above, a method of moving the magenta developing cartridge 5*b*, located at a position shifted in phase from the mounting and demounting position by 90 degrees toward an upstream side with respect to the rotary rotational direction, to the mounting and demounting position after the mounting and demounting operation of the yellow developing cartridge 5*a* will be described. The cyan developing cartridge 5*c* and the black developing cartridge 5*d* can also be moved to the mounting and demounting position by the same method.

A rotational force of the dial 24 is transmitted to a rotary gear 21 via the intermediary drive transmission gear 22. As a result, the rotary 1 is rotatable. As shown in FIG. 14(*b*), by the operation of the dial 24 by the user, the rotary 1 is rotated in the direction of the indicated arrow C, so that the yellow developing cartridge 5*a* is moved from the mounting and demounting position in the direction of the arrow C.

For this reason, the pressing of the slidable member 19*a* for the lock release by the projection 20 provided to the (lock) releasing member 20 is released. Then, the engaging portions 17*e* and 17*f* slide in the direction of the arrow D to engage with the portions to be engaged 16*a* and 16*f*. Thus, the yellow developing cartridge 5*a* and the rotary 1 are placed in the temporarily locked state again.

Further, as shown in FIG. 14(*c*), when the rotary 1 is further rotated in the direction of the arrow C, the magenta developing cartridge 5*b* reaches the mounting and demounting position. At this time, the portions to be engaged 16*e* and 16*f* of the magenta developing cartridge 5*b* engage with the projections 17*ea* and 17*fa* provided at ends of the engaging portions 17*e* and 17*f*. Thus, the magenta developing cartridge 5*b* and the rotary 1 are placed in the temporarily locked state in which the magenta developing cartridge 5*b* is detachably mountable to the rotary 1. As a result, the user can access each developing cartridge and can mount and demount the each developing cartridge. Further, only the developing cartridge located at the mounting and demounting position is detachably mountable and at other positions, other developing cartridges and locked in the rotary 1 and are placed in a held state.

As described above, the developing cartridge is detachably mountable only when the developing cartridge is located at the mounting and demounting position. At other positions, the developing cartridge is locked in the rotary 1. In other words, in a state in which the mounting portion for the developing cartridge is located at a position (another position)

other than the mounting and demounting position, the engaging portion is regulated at the above-described regulating position. Further, in a state in which the mounting portion for the developing cartridge is located at the mounting and demounting position, the engaging portion is movable from the regulating position to the permitting position. For that reason, it is possible to ensure prevention of disengagement of the developing cartridge with reliability. Further, during the mounting and demounting operation, when the mounting and demounting cover 13 is opened and the developing cartridge is moved to the mounting and demounting position, the developing cartridge 5 is placed in the temporarily locked state as described above, so that the user can perform the mounting and demounting operation only by gripping the grip 54. Thus, with a further simplified and downsized constitution, the prevention of the disengagement of the developing cartridge and improvement in operativity with respect to the mounting and demounting operation are realized, As described above, according to the present invention, it is possible to prevent the developing cartridge from being disengaged from the rotary. Further, the user can perform the mounting and demounting operation of the developing cartridge by a simple operation, so that user operativity can be improved. Further, it is possible to provide the image forming apparatus including such a developing cartridge with a simple constitution.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 223143/2008 filed Sep. 1, 2008, which is hereby incorporated by reference.

What is claimed is:

1. An image forming apparatus comprising:

a developing cartridge including a portion to be engaged and a developing roller for developing a latent image formed on an image bearing member; and a rotatable member that includes a mounting portion for permitting mounting and demounting of said developing cartridge and includes an engaging portion engageable with the portion to be engaged in a state in which said developing cartridge is mounted to said mounting portion, said rotatable member being rotatable for moving said mounting portion between a mounting and demounting position, in which said developing cartridge is mountable and demountable, and another position, wherein said engaging portion is movable between a regulating position, in which disengagement of said developing cartridge from said mounting portion is suppressed, and a permitting position in which the disengagement of said developing cartridge from said mounting portion is permitted, and wherein, in a state in which said mounting portion is located at another position, said engaging portion is regulated at the regulating position and, in a state in which said mounting portion is located at the mounting and demounting position, said engaging portion is movable from the regulating position to the permitting position.

2. An apparatus according to claim 1, further comprising a main assembly frame that is provided at a periphery of said rotatable member and is provided with an opening through which said developing cartridge passes when said developing cartridge is mounted and demounted in the state in which said mounting portion is located at said mounting and demounting position, and comprising a cover movable between a closing position in which the opening is to be closed and an opening position in which the opening is to be opened, wherein said cover is moved from the closing position to the opening position in the state in which said mounting portion is located at the mounting and demounting position, thereby to move said engaging portion from the regulating position to the permitting position.

3. An apparatus according to claim 1, wherein said engaging portion includes a locking portion and a temporarily locking portion, wherein said locking portion is engaged with said portion to be engaged in a state in which said engaging portion is located at the regulating position, wherein said locking portion is retracted from said portion to be engaged and said temporarily locking portion enters said portion to be engaged in a state in which said engaging portion is located at the permitting position, and wherein said developing cartridge is demounted from said mounting portion in the state in which said engaging portion is located at the permitting position, whereby said temporarily locking portion receives a force from said portion to be engaged so as to be retracted from said portion to be engaged.

4. An apparatus according to claim 3, wherein said temporarily locking portion is located on an end side of said engaging portion.

5. An apparatus according to claim 3, wherein each of said locking portion and said portion to be engaged is a surface substantially perpendicular to a mounting and demounting direction of said developing cartridge and said temporarily locking portion is an inclined surface inclined with respect to the surface, wherein said temporarily locking portion and said portion to be engaged overlap with each other with respect to the mounting and demounting direction when said engaging portion is located at the permitting position, and by demounting said developing cartridge from said mounting portion, said portion to be engaged urges said temporarily locking portion so as to be retracted from said portion to be engaged.

6. An apparatus according to claim 1, wherein said developing cartridge includes a portion to be guided that is guided by said rotatable member and is projected in a longitudinal direction of said developing cartridge when said developing cartridge is mounted to and demounted from said mounting portion, and wherein said portion to be guided includes said portion to be engaged.

7. An apparatus according to claim 2, further comprising a manually operating portion to be operated for manually rotating said rotatable member, wherein said manually operating portion is operated to rotate said rotatable member in a state in which the cover is opened, thereby to locate said mounting portion at the mounting and demounting position so as to permit mounting and demounting of said developing cartridge.

8. An apparatus according to claim 1, wherein said rotatable member includes a plurality of mounting portions and a plurality of engaging portions provided correspondingly to said mounting portions.

* * * * *